US007159806B1

(12) United States Patent
Ritsema

(10) Patent No.: US 7,159,806 B1
(45) Date of Patent: Jan. 9, 2007

(54) CUTTER ASSEMBLY FOR A GRINDER PUMP

(76) Inventor: Stephen T. Ritsema, 2373 Reed Rd., Bergen, NY (US) 14416

( * ) Notice: Subject to any disclaimer, the term of this patent is extended or adjusted under 35 U.S.C. 154(b) by 169 days.

(21) Appl. No.: 11/037,621

(22) Filed: Jan. 18, 2005

(51) Int. Cl.
*B02C 23/36* (2006.01)

(52) U.S. Cl. ..... 241/46.06; 241/89.4; 241/258; 415/121.1

(58) Field of Classification Search ..... 241/46.017, 241/46.06, 88.1, 89.4, 95, 257.1, 258, 260, 241/282.1, 82.5; 415/121.1
See application file for complete search history.

(56) References Cited

U.S. PATENT DOCUMENTS

| | | | |
|---|---|---|---|
| 3,650,481 | A | 3/1972 | Conery et al. |
| 3,961,758 | A | 6/1976 | Morgan |
| 4,108,386 | A | 8/1978 | Conery et al. |
| 4,378,093 | A | 3/1983 | Keener |
| 4,454,993 | A | 6/1984 | Shibata et al. |
| 4,640,666 | A | 2/1987 | Sodergard |
| 4,697,746 | A | 10/1987 | Nishimori |
| 4,842,479 | A | 6/1989 | Dorsch |
| 5,016,825 | A | 5/1991 | Carpenter |
| 5,044,566 | A | 9/1991 | Mitsch |
| 5,256,032 | A | 10/1993 | Dorsch |
| 6,010,086 | A | 1/2000 | Earle et al. |
| 6,190,121 | B1 | 2/2001 | Hayward et al. |

OTHER PUBLICATIONS

Hydromatic HPGR200 Submersable Sewage Grinder Pump 2 pages product lit from web site http://www.hydromatic.com/grinders/hpgr_grinder.html printed Apr. 19, 2005, known ~Sep. 2004.
Little Giant Pump Company 20G Series Automatic Grinder, 2 pages product literature, Form No. 995241—Jun. 2000.
ZoellerPump Company The Shark 820 Grinder Pump, 4 pages product literature, Section 2.50.010 FM1478 0803.
Goulds Pumps 4 pages product literature, Form No. BRGS2012, Effective Oct. 2003.
ABS Pirhana 08-110 4 page technical product brochure downloaded from http://www.abspumps.com/absgroup/ and printed Apr. 19, 2005. Original publication date unknown.
ABS Wastewater application brochure p. 9 and p. 5, downloaded from http://www.abspumps.com/absgroup/ and printed Apr. 19, 2005. Original publication date unknown.

*Primary Examiner*—Mark Rosenbaum
(74) *Attorney, Agent, or Firm*—John M. Hammond; Patent Innovations LLC

(57) ABSTRACT

A cutting assembly for a grinder pump comprised of a rotary cutter rotatable against an opposing plate cutter. The cutting edges of the plate cutter include a plurality of V-slice cutting teeth, which create bridging spaces to pinch material which is being sucked in to ports and begin cutting along the V-slice and then for cut material to pass through and onward into the volute of the pump. The rotary cutter has a ground edge with a rake angle which shears the gathered material in cooperation with the cutting edges of the plate cutter. A grinder pump including the cutter assembly is also disclosed.

20 Claims, 8 Drawing Sheets

CUTTER ASSEMBLY FOR A GRINDER PUMP

This invention relates in one embodiment to a grinder pump, and more particularly to such a pump with a grinding impeller and cutter assembly for grinding, cutting, shredding, and/or comminuting suspended solids in a liquid, and for simultaneously pumping a slurry of such suspended solids.

FIELD OF THE INVENTION

A grinding impeller and cutter assembly for a grinder pump for reducing the size of suspended solids in a liquid stream and simultaneously pumping such liquid stream.

BACKGROUND OF THE INVENTION

Grinder pumps are commonly used in liquid transfer applications that require the grinding of large solid or semisolid materials contained in a liquid, in order to grind, cut, or shred such materials. Ultimately, such solid or semisolid materials are reduced in size to the point where a slurry is formed, which is more easily pumped or otherwise transported, and which is more disposable than the solids themselves. Grinder pumps typically have an axial inlet connected to a pumping chamber, and a driven shaft extending through the pumping chamber and into the inlet. The shaft rotates a cutting cylinder in proximity to an annular ring, or a cutting disk in proximity to a plate cutter, thereby effecting the cutting action of the pump. Numerous other variations and configurations of grinder pumps are known, which are intended to provide shearing action between shearing parts operating cooperatively at close tolerances.

A number of patents have disclosed such grinder pumps, the relevant portions of which may be briefly summarized as follows:

U.S. Pat. No. 3,650,081 of Conery et al. discloses a grinder pump including an electric motor drive, a cooperating cutter blade, and grinder members, one of which is secured to the motor shaft at an inlet for the unit.

U.S. Pat. No. 3,961,758 of Morgan discloses a submersible pump for pumping liquids and liquid slurries, and for concurrently grinding and comminuting solid and semi-solid material contained in the liquid product to be pumped. The liquid product is initially shredded by a cutter bar and then drawn upwardly through a grinding and comminuting section where an abrasive drum mounted on a rotary drive shaft cooperates with an interior cylindrical stator surface to grind and comminute solids and semi-solids contained in the liquid product. From the grinding section, the resulting slurry is drawn into a centrifugal pump section with an impeller having a frusto-conical pumping face formed with symmetrical pumping cavities that are operable in both directions of rotation.

U.S. Pat. No. 4,108,386 of Conery et al. discloses a grinding pump including a comminutor located at the pump inlet to grind solid material as it passes therethrough and into a pumping chamber. The comminutor includes a stationary annular ring in the inlet having a plurality of grinding teeth which form the internal diameter of the ring. A cutting impeller is rotatable within the ring and has at least one blade which extends from one side of the impeller body axially outwardly beyond the ring to force the material between the teeth of the ring. The other side of the impeller body is provided with means to provide additional shearing of the material and prevent clogging of the material between the teeth of the ring.

U.S. Pat. No. 4,378,093 of Keener discloses a grinder pump cutter assembly specifically adapted to be useful in grinding rubber and other elastomeric substances. The grinder pump cutter assembly comprises a pair of cutting blades mounted on a cutter disk which extend at a hook angle to substantially the center of the disk, and a blade that is multi-surfaced, with the surfaces thereof being angled toward the periphery of the disk to break up centralized matter and disperse it into cutting engagement between the disk and a cutter ring.

U.S. Pat. No. 4,454,993 of Shibata et al., discloses a grinder pump which includes a motor driven impeller, a grinder ring fitted in the suction port at the bottom of a pump casing, the grinder ring being provided with a plurality of axially extending grinding grooves and edges on the inner surface thereof, and a grinder impeller fixedly screwed on the distal end of the pump shaft, the grinder impeller being provided with at least two axially extending grinding blades provided on the lower conical surface of the hub thereof so that any foreign material contained in the pumping liquid is ground or shredded into smaller pieces by cooperation of the grinding edges of the grinder ring with the grinding blades of the grinder impeller.

U.S. Pat. No. 4,640,666 of Sodergard discloses a grinder pump comprising a pump housing having an internal surface bounding a central inlet and provided with grooves and an impeller having at least a portion received in the inlet for rotation therein, the portion being substantially cylindrical and having a diameter which is smaller than that of the inlet, the portion having substantially axially extending cutting means which project radially from the portion to cooperate with the grooves to cut solid objects such as rags and other elongated objects.

U.S. Pat. No. 4,697,746 of Nishimori discloses a release type grinder pump that is capable of readily permitting the fitting and removal of a grinder ring with respect to a pump casing. The grinder pump includes an annular suction cover in which the grinder ring is fittedly held and which is detachably fitted in the pump casing so as to surround a suction port and allow the grinder ring not to have any portion directly held within the pump casing.

U.S. Pat. No. 4,842,479 of Dorsch discloses a high head centrifugal slicing slurry pump comprising a booster propeller that is located at the inlet of a flared funnel leading toward arcuate inlet apertures in an end plate of a centrifugal pump casing. The propeller has radially projecting blades of generally right triangular cross section with bases formed of the broad trailing sides and broad bottom sides remote from an impeller; the hypotenuse side of each blade being a broad upper surface inclined relative to a plane perpendicular to the axis for propelling slurry toward the inlet apertures of the pump.

U.S. Pat. No. 5,016,825 of Carpenter discloses a cutting assembly for a grinder pump comprising a disk member rotatable within an opposing annular ring. The inner circumferential surface of the annular ring carries a plurality of cutting teeth, which partially extend at an angle along the lateral dimension of the inner circumferential surface. The disk member has an annular edge which separates a side distal to the pump inlet and a side proximal to the inlet. At least one projection extends from the distal side and has a leading edge facing toward the direction of normal shaft rotation. At least one cutting member extends from the proximal side and also has a leading edge. The proximal side has a recess forming first and second cutting edges. Similarly, the distal side has a recess having first and second cutting edges. The proximal recess overlaps the distal recess along the width of the annular edge.

U.S. Pat. No. 5,044,566 of Mitsch discloses a grinder pump comprised of a housing; a shaft disposed within the housing, a moveable cutter carried on and rotationally coupled to the shaft. A stationary cutter is held within the housing and the moveable cutter cooperates with the stationary cutter to perform cutting along respective surfaces of the moveable cutter and the stationary cutter. The respective surfaces of the stationary and moveable cutters are substantially within a plane that is substantially perpendicular to the axis of the shaft. The pump includes an apparatus that resiliently biases the moveable cutter against the stationary cutter.

U.S. Pat. No. 5,256,032 of Dorsch discloses a centrifugal chopper pump comprising open impeller with vanes having cutting edges at both the intake side of the pump bowl and the closed side of the bowl. The cutting edges of the vanes cooperate with narrow anvil ribs projecting inward from both sides of the pump bowl such that solid matter in the material being pumped is sliced and chopped inside the bowl.

U.S. Pat. No. 6,010,086 of Earle et al. discloses a grinder pump comprised of a pump assembly, a grinder mechanism, and a motor disposed between the grinder mechanism and the pump assembly. A shaft of the motor is operably attached at one end thereof to the grinder mechanism and at the other end thereof to the pump assembly to provide small radial clearances between the cutting portions of the grinder mechanism. In one embodiment, vortex-type impeller vanes are associated with a grinding head of the grinder mechanism to assist flow of effluent from the grinder mechanism to the pump assembly via a passageway extending about, and/or in parallel with, a motor mounting unit.

U.S. Pat. No. 6,190,121 of Hayward et al. discloses a centrifugal pump with solids cutting capability comprising an impeller having a plurality of radially extending vanes connected to a hub and a partial back shroud with sharpened leading edges. The pump has a pump casing with a back plate adjacent to the back side of the impeller, wherein spiral grooves on the back plate interact with the sharpened edges on the back shroud to aid in protecting the area between the back plate and the impeller by cutting of solids and expulsion of solids through an output port. The leading edges on the back shroud are preferably also serrated and beveled and the spiral grooves are outward threaded. A disintegrator is preferably mounted on the end of the drive shaft in the conical intake of the pump. Cutting bars on the front plate of the casing project into the pump intake and interact with front edges of the vanes to cut incoming solids in a liquid mixture.

The disclosures of each of these United States patents are incorporated herein by reference.

Also known is the Shark® 820 grinder pump manufactured and sold by the Zoeller Co. of Louisville, Ky. This pump is comprised of a star-shaped cutter rotating against a stationary flat disc having inlet apertures, with radial grooves disposed between such apertures.

Also known is the Piranha® Grinder pump manufactured and sold by the ABS Corporation. This pump is comprised of an intake plate having spiral cutting grooves on the inside thereof cooperating with the edges of the pump impeller vanes, which are flat in profile. The cutter design of this pump is susceptible to binding problems because material is cut in large pieces and such material can become wedged either in the cutter or between the impeller edges and the intake spiral cutting plate. Also the discharge of this pump can become clogged under severe operating conditions.

It is known that that the configuration of the cutting disk and annular ring, or of the other shearing parts are of high importance in the operation of grinder pumps. The particular shearing parts must be capable of shearing a wide range of entrained solids in a liquid stream that is entering the pump. Such solids may have a wide variety of properties that are adverse to the operation of the pump, including high shear strength, abrasiveness, hardness, elasticity, and/or plasticity. Materials that are abrasive may gradually wear away the cutting edges of the grinding parts of the pump. Materials that have high shear strength and/or high hardness may shatter or deform the cutting edges of the grinding parts of the pump. Materials that undergo elastic and/or plastic deformation may be particular resistant to the cutting action by the grinding parts of the pump. Instead of being cleanly cut up into smaller parts, these materials may deform and "gum up" or otherwise clog the grinding pump.

Fibrous, string-like materials suspended in a liquid are particularly difficult to shred with a grinder pump. On a local scale on the order of the fiber diameter, these materials have a relatively small cross section and are more difficult to shear by the cutting edges. In addition, the relatively long length and elastic or plastic properties often cause them to wrap around the internal pump components parts such as a cutting disk, an annular ring and a pump shaft. It is therefore desirable that the grinding parts of a grinder pump are not only capable of efficient grinding/cutting of solids or semi-solid materials, such as e.g. materials in a sewage stream, but also have the capability of grinding fibers and string-like materials that are suspended in such a stream. It is also desirable that the grinder pump be capable of rejecting any very hard objects that are not grindable, such as metal buttons, rivets and the like that may be on objects such as clothing items that are accidentally introduced into the stream. Numerous prior art grinder pumps are not capable of rejecting such hard objects, rendering them especially vulnerable to jamming at start up.

In addition, numerous prior art grinder pumps are not capable of grinding a sudden heavy load of fibrous material that may be encountered. Such grinder pumps will bog down and clog on the heavy fibrous load, or suddenly jam if a hard solid object is introduced into the cutting parts of the pump. The applicant's grinder pump comprised of his cutter assembly invention is capable of rejecting hard objects, and grinding a sudden heavy load of fibrous material. The applicant's grinder pump is also capable of grinding suspended solids into a sufficiently small size so as to produce a substantially homogeneous liquid. The applicant believes that such a capability enables his grinder pump to pump such a liquid at a higher pressure through a smaller diameter pipe. Because of these capabilities, the applicant's grinder pump including his cutter assembly invention is thus superior to prior art grinder pumps. Accordingly, embodiments of the present invention are provided that meet at least one or more of the following objects of the present invention.

It is an object of this invention to provide a grinder pump with a cutter assembly that is capable of grinding a sudden heavy load of solid fibrous material without stalling, or without becoming clogged and ceasing the pumping of liquid therethrough.

It is a further object of this invention to provide a grinder pump with a cutter assembly that is capable of grinding a substantial and continuous load of solid and semisolid material, including fibrous material, without stalling, or without becoming clogged and ceasing the pumping of liquid therethrough.

It is another object of this invention to provide a grinder pump with a cutter assembly that is capable of rejecting a piece of hard solid material, thereby preventing such material from jamming and stalling such pump, and ceasing the pumping of liquid therethrough.

It is a further object of this invention to provide a grinder pump comprised of a cutter assembly that renders such pump capable of pumping a homogenized liquid stream at a higher pressure and through a smaller diameter pipe.

SUMMARY OF THE INVENTION

In accordance with the present invention, there is provided a cutting assembly for size reduction of solids in a liquid to be pumped, the cutting assembly comprising a drive shaft rotatable in a first direction of rotation; a rotary cutter rotatably engaged with the drive shaft and comprised of at least a first cutting blade and a second cutting blade, each of the first and the second cutting blades including a leading cutting edge advanceable in the direction of rotation, the leading cutting edge formed at the junction of a leading side wall of the blade and a flat base of the blade; and a plate cutter comprised of an apertured wall including an inner discharge surface, and an outer cutter surface, the outer cutter surface including a plurality of cutting ports, each of the cutting ports comprising an entry opening, a first orifice passing though the apertured wall to the inner discharge surface, and a second orifice passing though the apertured wall to the inner discharge surface. The entry opening further comprises a first V-slice cutting edge and a second V-slice cutting edge intersecting at an angle directed opposite to the direction of rotation; a first cutting edge of the first orifice connected to the first V-slice cutting edge; and a second cutting edge of the second orifice connected to the second V-slice cutting edge. When the rotary cutter is rotated in the first direction of rotation, the cutting blades are rotationally advanced along the outer cutter surface of the plate cutter in a shearing action against the first V-slice cutting edge, the second V-slice cutting edge, the first cutting edge of the first orifice, and the second cutting edge of the second orifice of the cutting ports of the outer cutter surface of the plate cutter.

In accordance with the present invention, there is provided a grinder pump comprising a housing including a motor housing portion enclosing a pump motor, and a volute portion forming a pump volute, said pump volute enclosing a pump impeller; a volute cover; and a cutting assembly for size reduction of solids in a liquid to be pumped, said cutting assembly as recited in the immediately foregoing description. In one embodiment, the plate cutter of the cutting assembly is integrally formed into the volute cover of the grinder pump.

BRIEF DESCRIPTION OF THE DRAWINGS

The invention will be described by reference to the following drawings, in which like numerals refer to like elements, and in which.

Figure 1:
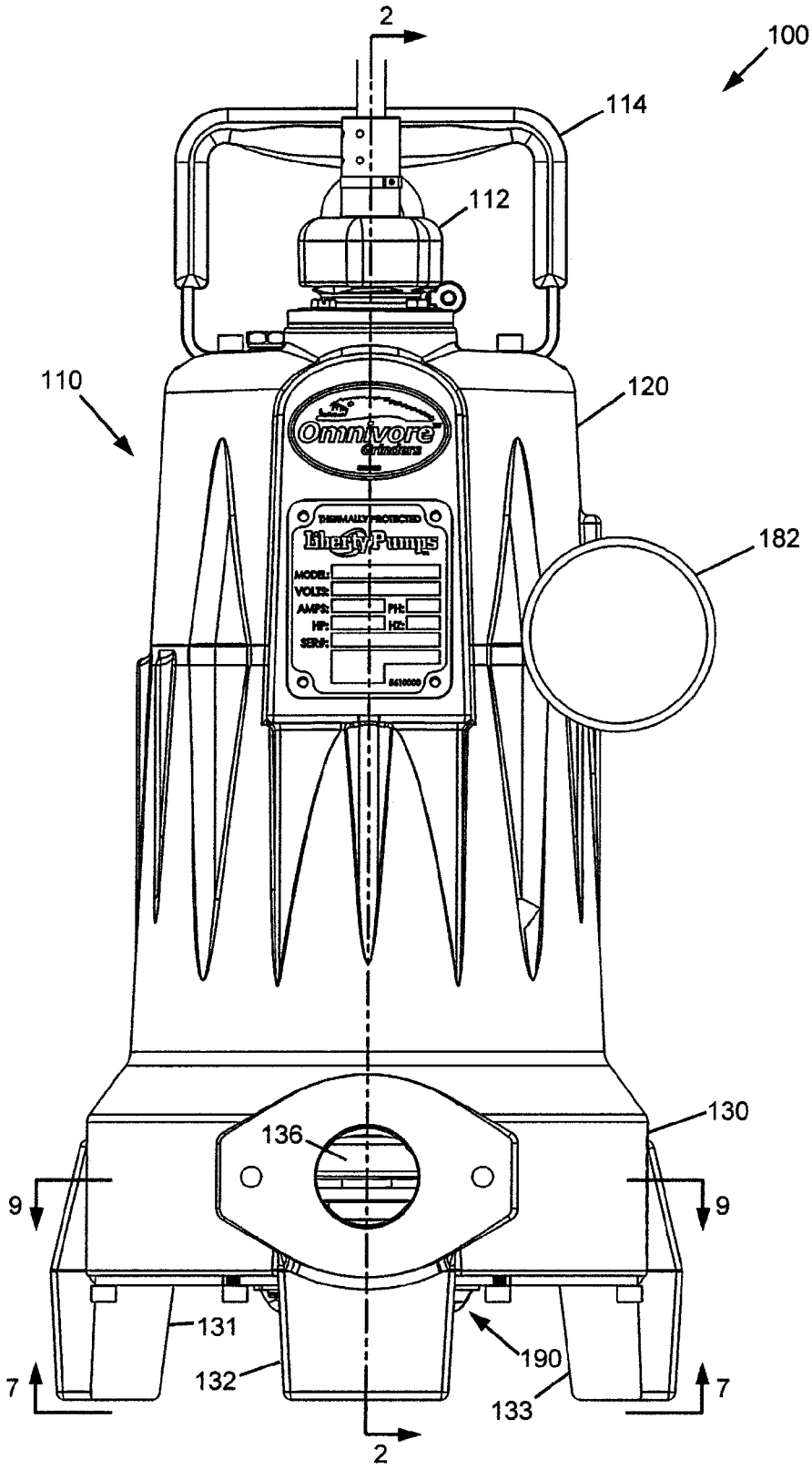
FIG. 1 is a side elevation view of a grinder pump that utilizes the rotary cutter and plate cutter assembly of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements. In describing grinding assemblies for size reduction of solids in liquids to be pumped, a variety of terms are commonly used in the description. A rotating blade device is commonly referred to as a grinder impeller or a rotary cutter. Herein, such terms may used interchangeably and are to be understood as meaning the same thing. It is also to be understood that a grinder impeller as used herein is distinct from a pump impeller, which is commonly understood to be a rotating vaned disc that draws a liquid into a central region thereof and centrifugally discharges such liquid outwardly in a pumping action.

An overall cutting assembly for size reduction of solids in liquids to be pumped is often referred to as a grinding impeller and cutter assembly, a cutting assembly, a cutter assembly, a grinder/cutter assembly, or a cutter assembly. Although the grinding apparatus herein will generally be referred to as a cutting assembly, it is to be understood that such terms where used are considered to be interchangeable.

The general construction of grinder pumps that utilize the applicant's cutter assembly may vary to some degree. FIG.

Figure 2:
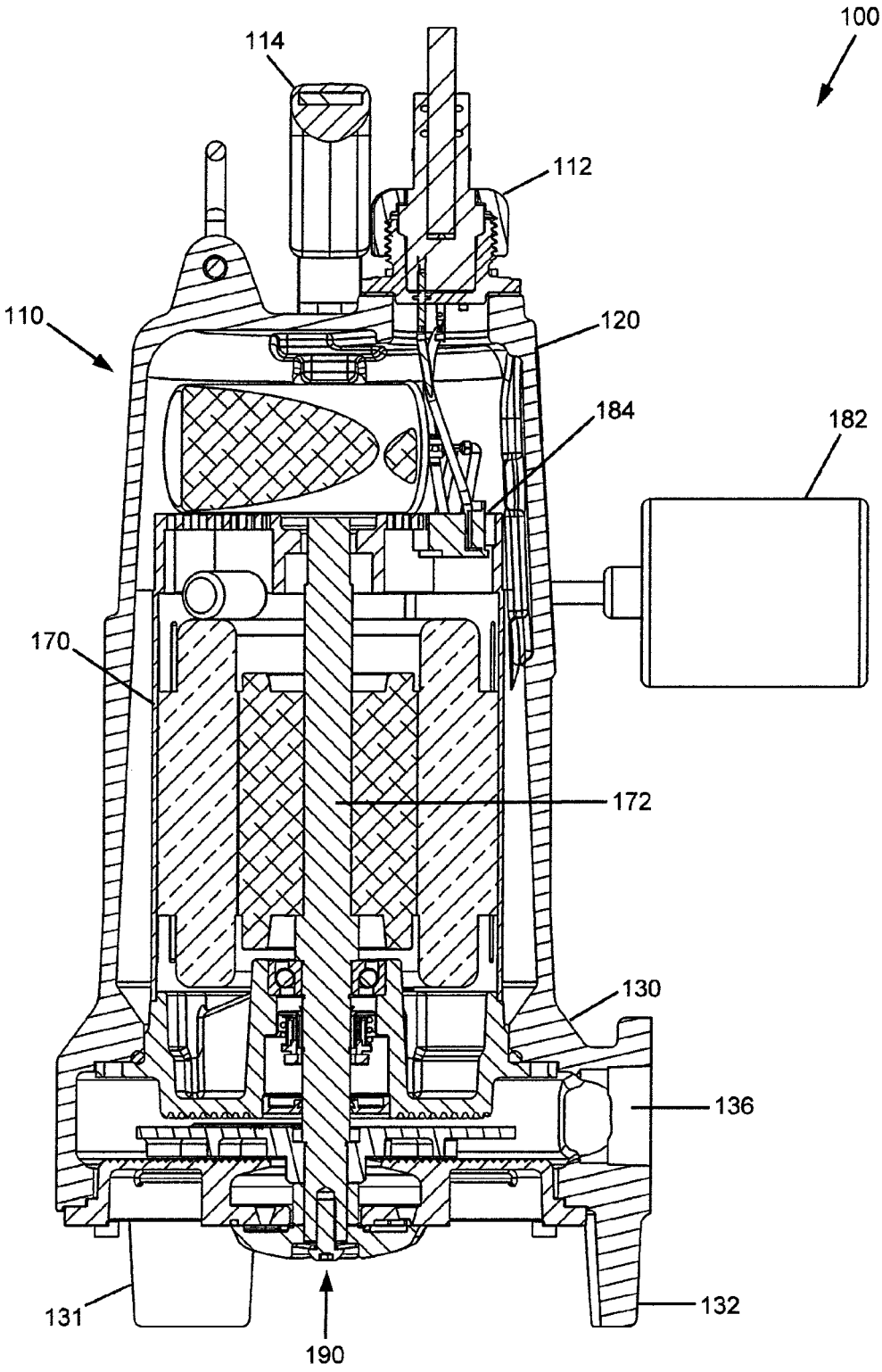
FIG. 2 is a cross-sectional view of the grinder pump of FIG. 1, taken along line 2—2 thereof.

1 is a side elevation view of one preferred embodiment of a grinder pump that utilizes the cutter assembly of the present invention; and FIG. 2 is a cross-sectional view of the grinder pump of FIG. 1, taken along line 2—2 thereof. Referring to FIGS. 1 and 2, pump 100 comprises a housing 110 including a motor portion 120 and a volute portion 130. Pump motor 170 is disposed within housing portion 120, and comprises motor drive shaft 172. Pump 100 may optionally comprise numerous other elements beneficial to the operation and control thereof, such as e.g., a float switch 182, and solid state switch 184 for turning off the start winding when motor 170 is started up. Such solid state switch is generally more reliable that a relay device. Pump 100 preferably further comprises sealed cord fitting 112, handle 114, and support feet 131, 132, and 133.

Figure 3:
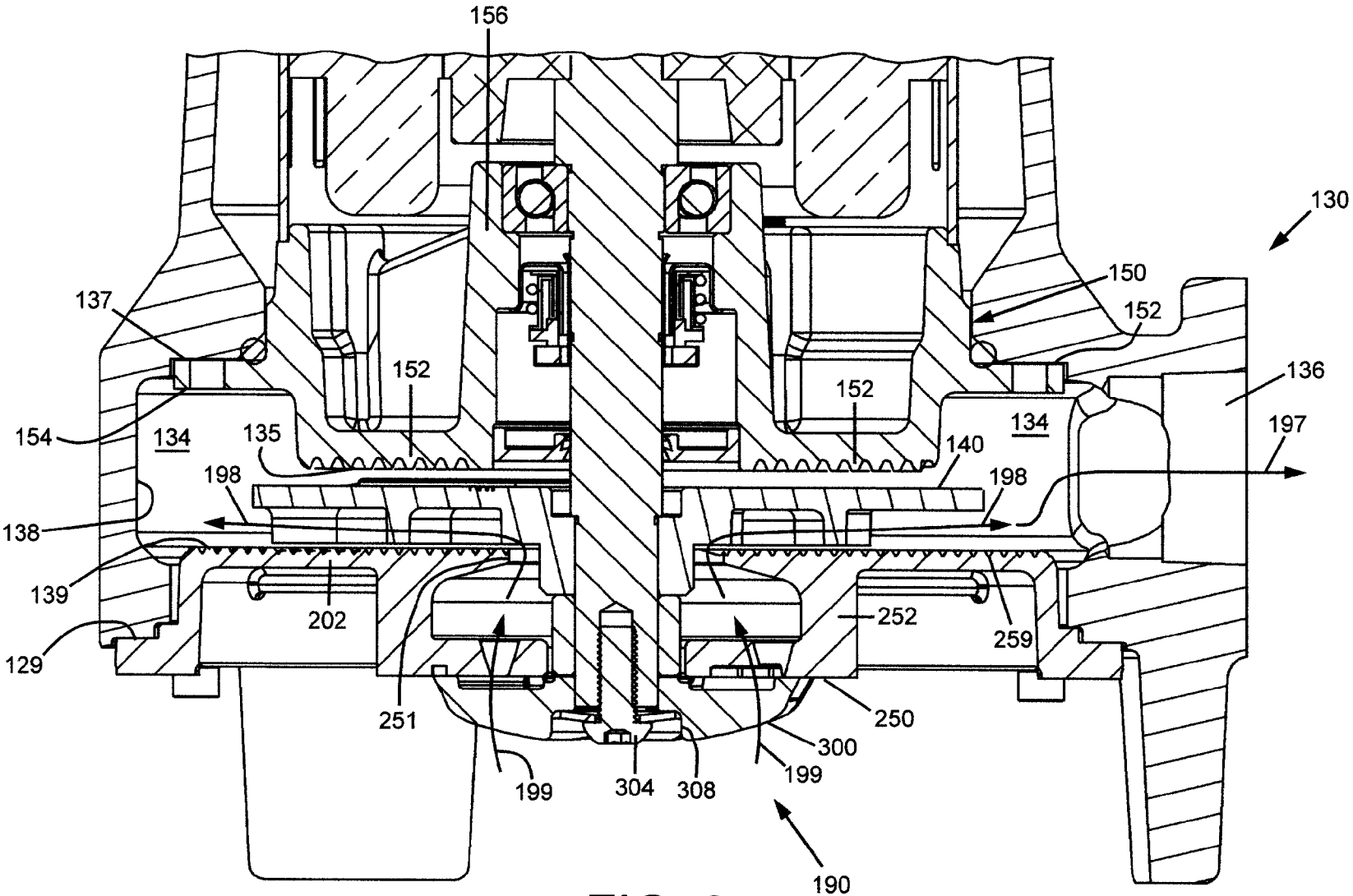
FIG. 3 is an enlarged cross-sectional view of the volute portion of the pump of FIGS. 1 and 2, including the pump volute and the rotary cutter and plate cutter assembly thereof.

FIG. 3 is an enlarged cross-sectional view of the volute portion of the pump of FIGS. 1 and 2, including the pump volute and the cutter assembly thereof. During the operation of pump 100, the grinding and size reduction of solids (not shown) in a liquid stream occurs by the action of cutter assembly 190 in the flow regions indicated by arrows 199. Ground up suspended/homogenized solids and liquid are drawn into pump 100 by spinning impeller 140 and are discharged into pump volute 134 as indicated by arrows 198, and are subsequently discharged out of outlet 136 as indicated by arrow 197.

Figure 4B:
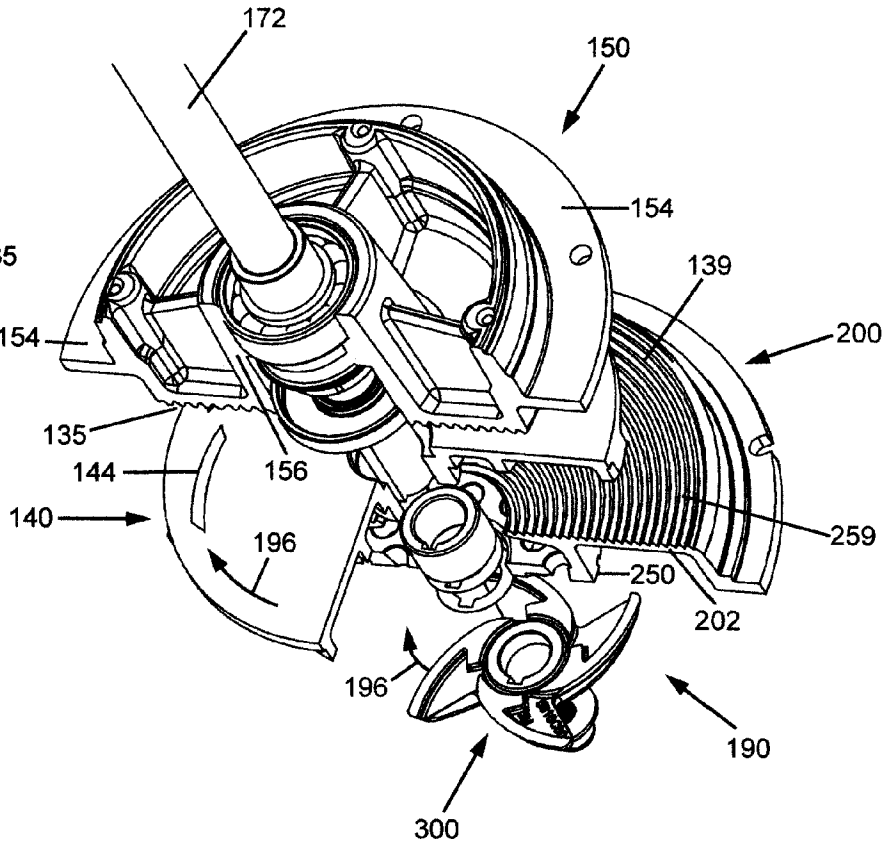
FIG. 4B is a downward perspective exploded view of the liquid/solid transporting components of the grinder pump, including the rotary cutter and plate cutter assembly.
Figure 4A:
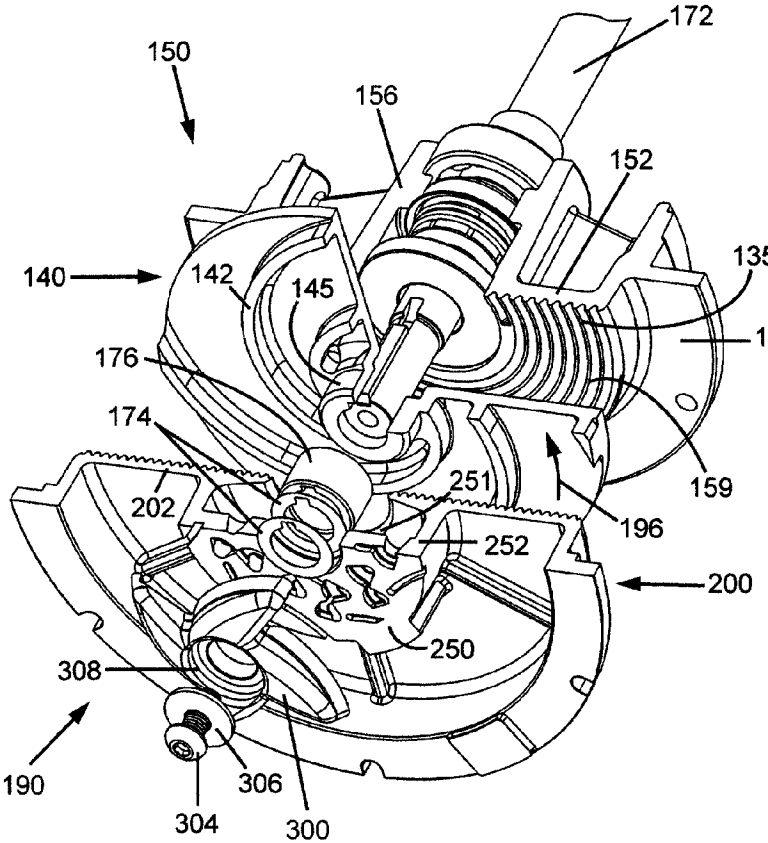
FIG. 4A is an upward perspective exploded view of the liquid/solid transporting components of the grinder pump, including the rotary cutter and plate cutter assembly.

The optimal construction and arrangement of certain pump components to form the pump volute, and the cooperative relationships of the various liquid/solid transporting components of the grinder pump are best understood with reference also to FIG. 4A and FIG. 4B, which are upward and downward perspective exploded views, respectively, of the liquid/solid transporting components of the grinder pump, including the rotary cutter and plate cutter assembly. It is noted in particular that pump 100 comprises a minimum of parts and simple construction to form a housing for motor 170 and volute cavity 134.

Referring to FIGS. 3, 4A, and 4B, the upper face 135 of volute cavity 134 is formed by wall 152 of motor plate 150. An upper receiving flange 137 is formed in volute portion 130 of housing 110, and mounting flange 154 of motor plate 150 is secured thereto by suitable fastening means such as e.g., bolts (not shown). Motor plate 150 further comprises a central housing 156 for the fitting of pump seals and a motor bearing therein. The outer circumferential wall 138 of volute 134 is formed in a downwardly extending section of volute portion 130 of housing 110, such section extending downwardly beyond receiving flange 137. The lower face 139 of volute cavity 134 is formed by wall 202 of bottom volute cover 200. A lower receiving flange 129 is formed in volute portion 130 of housing 110, and mounting flange 204 of volute cover 200 is secured thereto by suitable fastening means such as e.g., bolts (not shown).

Impeller 140 is mounted on and operatively coupled to drive shaft 172 by suitable means such as e.g. a key engaged in key slots formed in impeller 140 and shaft 172. Impeller 140 and rotary cutter 300 are rotated in the direction indicated by arrow 196 to effect the pumping of liquid through volute 134, and the grinding of solids in such liquid by cutter assembly 190 as will be described presently.

Figure 7:
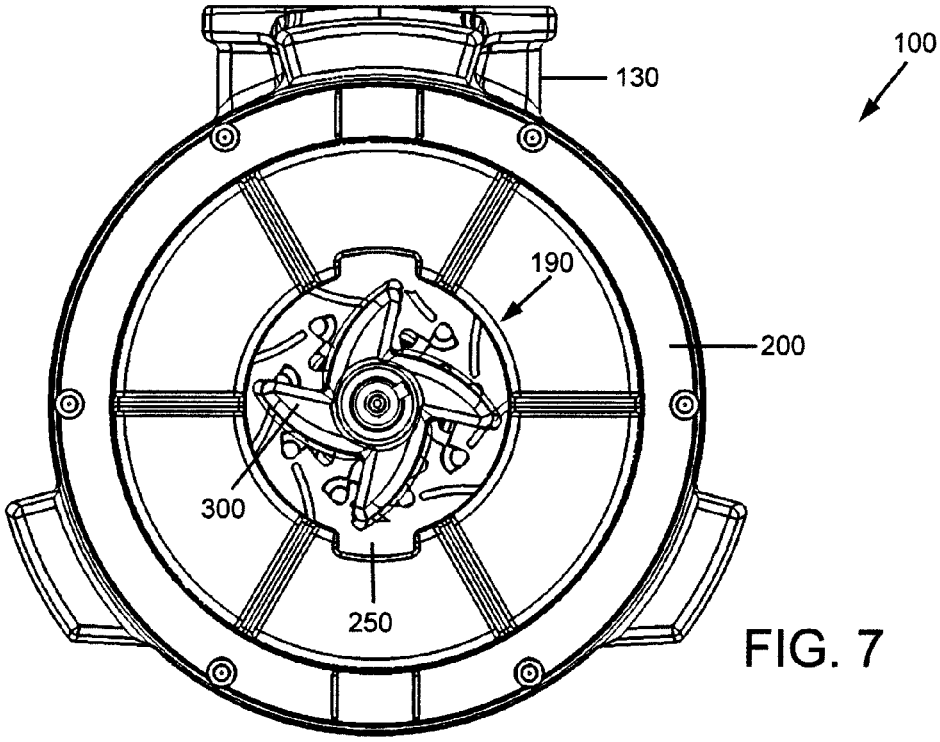
FIG. 7 is a bottom or exterior view of the grinder pump of FIG. 1 taken along line 7—7 of FIG. 1, and depicting the rotary cutter and plate cutter assembly of such grinder pump.
Figure 8:
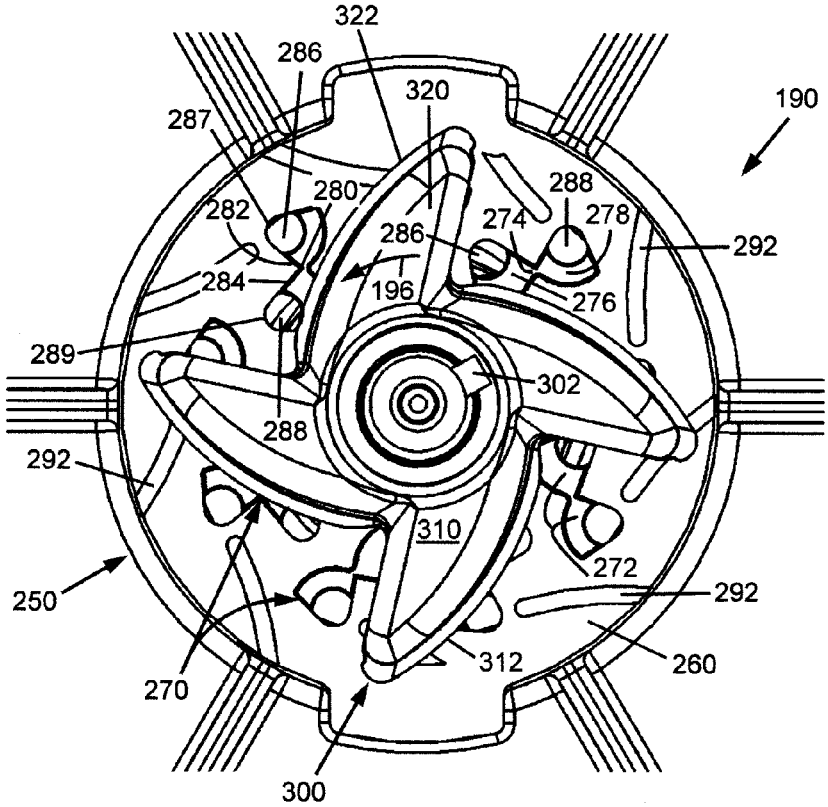
FIG. 8 is a magnified bottom or exterior view of the rotary cutter and plate cutter assembly depicted in FIG. 7.

The general arrangement of the components of cutter assembly is best understood with reference additionally to FIG. 7 and FIG. 8. Referring to FIGS. 3, 4A, 4B, 7, and 8, cutter assembly 190 is comprised of rotary cutter 300 and stationary plate cutter 250. Rotary cutter 300 is mounted on and operatively coupled to drive shaft 172 by suitable means such as key 302, bolt 304, and washer 306. In operation, rotary cutter 300 spins with the rotation of shaft 172, and the leading cutting edges such as edge 312 of blade 310 are rotationally advanced along the outer cutter surface 260 of plate cutter 250 in a shearing action against the various cutting edges formed in cutter surface 260. Such cutting edges will be described in detail subsequently herein.

In the preferred embodiment of grinder pump 100, plate cutter 250 is formed as an integral part of bottom cover 200. Such a construction minimizes the parts needed for grinder pump 100, simplifies the assembly thereof, and reduces overall manufacturing cost. Plate cutter is formed as an annular boss 252 that extends downwardly from wall 202 of cover 200. Cutter surface 260 is ground flat such that in the operation of cutter assembly 190, surface 260 is perpendicular to drive shaft 172, and parallel to the plane of rotation of the cutting edges of the blades of rotary cutter 300. The running clearance between the cutting edges of the blades of rotary cutter 300 and cutter surface 260 may be selected during pump assembly or subsequently changed by the fitting of shims 174 between motor shaft bushing 176 and the base of rotary cutter 300.

The magnitude of the running clearance between the cutting edges of the blades of rotary cutter 300 and cutter surface 260 is selected according to the properties of the suspended solids in the liquid to be processed and upon the materials of construction of plate cutter 250 and rotary cutter 300. In one embodiment, cutter assembly 190 may be made self-sharpening, wherein there is zero running clearance between the cutting edges of the blades of rotary cutter 300 and cutter surface 260. Preferably, there is provided between about 0.002 inches and about 0.10 inches of running clearance. In such an embodiment, plate cutter 250 may be made of a suitable metal alloy including but not limited to a martensitic stainless steel alloy and rotary cutter 300 may also be made of a suitable metal alloy including but not limited to a martensitic stainless steel alloy. In one preferred embodiment, plate cutter 250 and rotary cutter 300 are both made of 440 Stainless steel hardened to approximately 58 Rockwell C.

In other embodiments, the rotary cutter and/or the plate cutter may be made of technical ceramics that exhibit superior wear resistance and strength including but not limited to aluminum oxide (alumina) ceramic, chromium oxide (chromia) ceramic, titanium oxide (titania) ceramic, zirconium oxide (zirconia) ceramics, including fully and partially stabilized zirconia, and combinations of such metal oxides; and silicon nitride, silicon carbide, or tungsten carbide. In a further embodiment, the rotary cutter and/or the plate cutter may be made of a metal alloy coated with a suitable wear resistant thin film coating such as hard chrome, titanium nitride, or the technical ceramics recited herein. Processes such as e.g., electroplating are well known for applying a layer of a protective metal such as hard chrome, as are process such as e.g. plasma deposition for applying ceramics and other protective non-metallic thin films to metal substrates.

In the preferred embodiment, plate cutter 250 and rotary cutter 300 are each provided with certain unique features that enable superior cutting and grinding performance by cutter assembly 190. Although not every particular feature is required to achieve solids grinding by cutter assembly 190, the applicant believes that providing cutter assembly 190 with these features provides the best grinding performance, and superior performance to prior art grinder assemblies. The preferred features of rotary cutter 300 will now be described, then followed by the preferred features of plate cutter 250, then followed by a summary of the cooperative working of rotary cutter 300 against plate cutter 250 to achieve solids grinding.

Figure 5B:
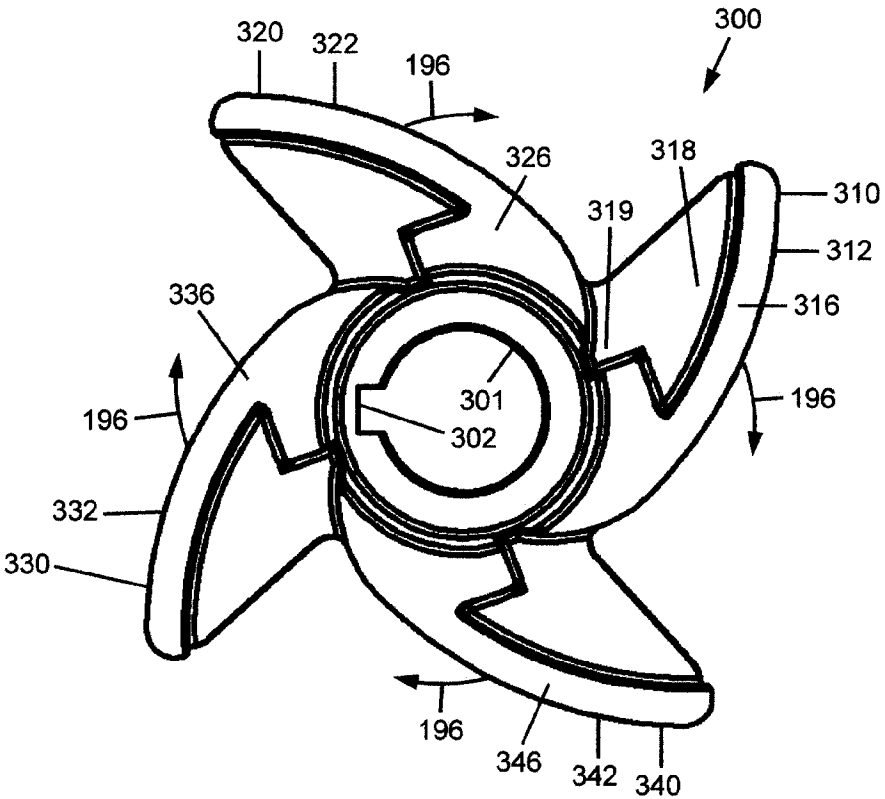
FIG. 5B is an interior view of the rotary cutter of FIG. 5A.
Figure 5A:
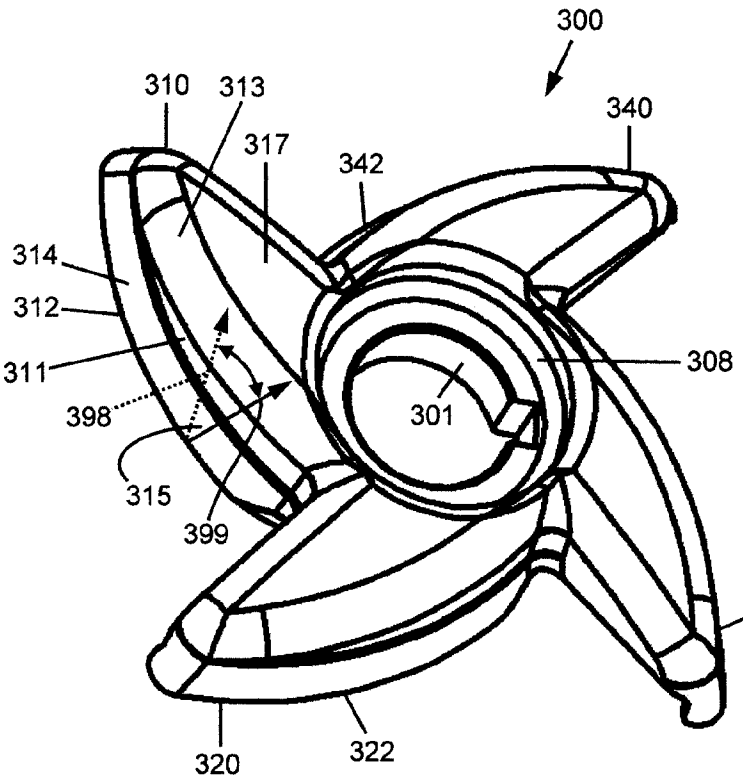
FIG. 5A is an exterior perspective view of a preferred rotary cutter of the grinder and cutter assembly of the grinder pump depicted in FIG. 2.

The preferred features of rotary cutter 300 are best understood with reference additionally to FIG. 5A and FIG. 5B. FIG. 5A is an exterior perspective view of a preferred rotary cutter of the grinder and cutter assembly of the grinder pump depicted in FIG. 2; and FIG. 5B is an interior view of the rotary cutter of FIG. 5A. Referring to FIGS. 5A and 5B, rotary cutter 300 is provided with a plurality of cutting blades. At minimum, rotary cutter 300 is provided with at least two cutting blades spaced at 180 degrees for proper balance. In one preferred embodiment depicted in FIGS. 5A and 5B, rotary cutter 300 is provided with four cutting blades 310, 320, 330, and 340 spaced at 90 degree intervals. It will be apparent that other suitable configurations of rotary cutter 300 may be provided, such as e.g. three blades spaced at 120 degree intervals. Rotary cutting blade 300 is further provided with a shaft bore 301 having a keyway 302 for mounting on shaft 172 (see FIG. 4A) as described previously.

Blades 310, 320, 330, and 340 are provided with ground leading cutting edges 312, 322, 332, and 342, respectively. In the preferred embodiment, cutting edges 312–342 are provided with an arcuate shape such that these edges sweep outward from the central region of cutter 300 and backward, i.e. in a direction opposite the direction of rotation indicated by arrows 196. This arcuate shape provides a superior shearing and scissoring action when such edges cut against the cutting edges of plate cutter 250 to be described subsequently herein. The applicant believes that such a shape also reduces liquid drag on the rotary cutter during operation, thereby reducing the torque load on the pump motor 170 (see FIG. 2).

The details of the preferred construction of blade 310 of rotary cutter 300 will now be provided, with it being understood that in the preferred embodiment, each of blades 320, 330, and 340 are identical to blade 310. Referring again to FIGS. 5A and 5B, cutting edge 312 of blade 310 is formed at the junction of leading side wall 314 and flat base 316. In one embodiment, leading side wall 314 is perpendicular to flat base 316. However, in the preferred embodiment, leading sidewall 314 is tilted backward opposite the direction of rotation, thereby forming an acute rake angle 315 with flat base 316. Rake angle 315 is defined as the angle between vector 399 directed up the slope of leading sidewall 314 and vector 398 directed along base 316, with both of such vectors lying in a plane perpendicular to a tangent to cutting edge 312 at the particular point on cutting edge 312. Rake angle 315 is preferably between about 60 degrees and about 90 degrees. In one preferred embodiment depicted in FIGS. 5A and 5B, rake angle 315 is 67.5 degrees.

The provision of blades 310–340 with such acute rake angles at cutting edges 312–342 provides such blades with better shearing action with plate cutter 250, and with an effect that pushes shorn solids outward and away from the cutting edges, to help prevent clogging and/or jamming of cutter assembly 190. The rake angle also begins a transition to angled surfaces 311, 313, and 317, which are formed to streamline blade 310, thereby reducing liquid drag and the torque load on pump motor 170.

In an alternate embodiment, blades 310–340 are provided with obtuse rake angles 315. The use of obtuse rake angles provides a downward force on the solids impinging on leading sidewall 314, thereby assisting such solids in being forced through the orifices 286 and 288 (see FIG. 8) of plate cutter 250. Such obtuse rake angle 315 is preferably between about 90 degrees and about 120 degrees.

It will be apparent that flat bases 316, 326, 336, and 346 are all coplanar in order to provide cutting action with cutting surface 260 of plate cutter 250. Cutting blade 310 (et seq.) is provided with a first recessed area 318 located adjacent to flat base 316 on the outer portion of such blade 310, and a second recessed area located adjacent to flat base 316 proximate to the central region of rotary cutter 300. These recessed areas work cooperatively with exclusion slots on cutting surface 260 of plate cutter 250 in a manner to be described subsequently herein.

Referring again to FIGS. 3, 4A, and 5A, rotary cutter is preferably provided with a counterbore 308 which receives and provides a shroud for the head of bolt 304 or other suitable fastener when rotary cutter is fitted and secured to shaft 172. This shrouding effect is made more beneficial by the selection of a bolt 304 having a radiused head (e.g. a pan-head or dome-head bolt or screw) as depicted in FIG. 3 in particular. In this manner, there are no exposed sharp edges resulting from the fitment of bolt 304 to the assembly. The applicant has discovered that this is beneficial in that if a bolt with a head having exposed sharp-edges is used (such as a hex-head bolt), and such bolt head is exposed rather than countersunk into recess 308, any stringy fibrous solid material present in the liquid to be processed will likely become wrapped around and entangled with such bolt head, thereby reducing liquid flow and further loading the pump motor 170.

Figure 6C:
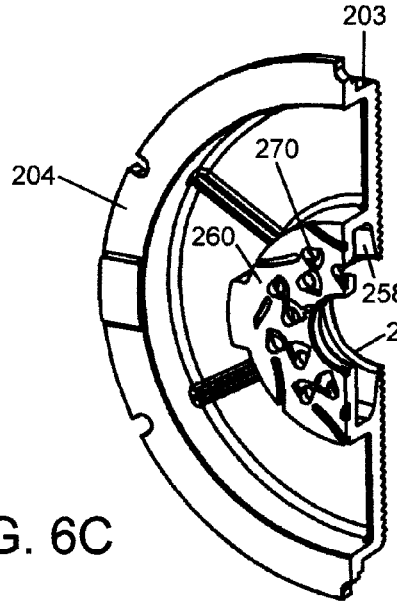
FIG. 6C is an exterior cutaway perspective view of the cover of FIG. 6A, cut along the line 6BCD—6BCD of FIG. 6A.
Figure 6D:
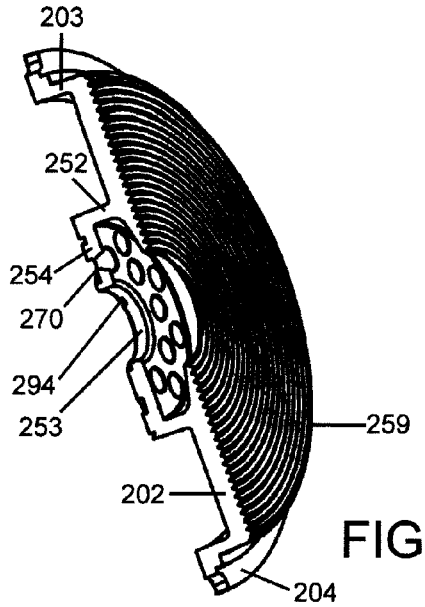
FIG. 6D is an interior cutaway perspective view of the cover of FIG. 6A, cut along the line 6BCD—6BCD of FIG. 6A.
Figure 6A:
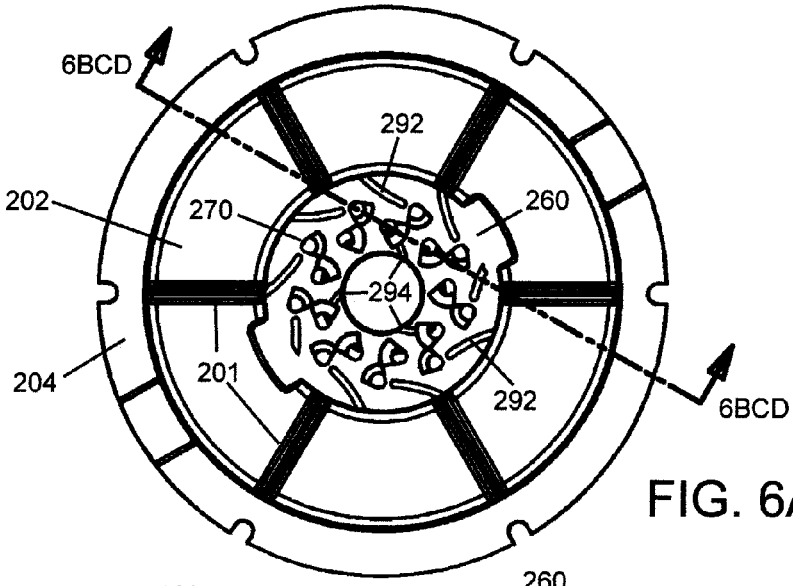
FIG. 6A is a bottom view of a volute cover of the applicant's grinder pump that includes a plate cutter of the rotary cutter and plate cutter assembly.
Figure 6B:
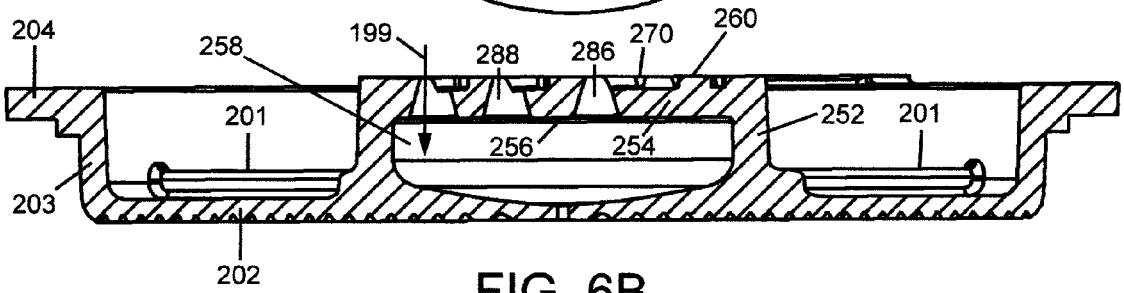
FIG. 6B is a cross-sectional view of the cover of FIG. 6A, taken along the line 6BCD—6BCD of FIG. 6A.

The preferred features of plate cutter 250 to be presently described are best understood with reference additionally to FIGS. 6A–6D. FIG. 6A is a bottom view of the preferred volute cover 200 of the applicant's grinder pump that includes a plate cutter 250 of the cutter assembly 190. FIG. 6B is a cross-sectional view of the cover of FIG. 6A, taken along the line 6BCD—6BCD of FIG. 6A; FIG. 6C is an exterior cutaway perspective view of the cover of FIG. 6A, cut along the line 6BCD—6BCD of FIG. 6A; and FIG. 6D is an interior cutaway perspective view of the cover of FIG. 6A, cut along the line 6BCD—6BCD of FIG. 6A.

Referring to FIGS. 6A–6D, bottom cover 200 is comprised of plate cutter 250, which is formed as an integral part of. Plate cutter is formed as an annular boss 252 that extends downwardly from wall 202 of cover 200. Wall 202 extends radially outward to an annular region 203, to which is joined mounting flange 204. Wall 202 preferably includes a plurality of reinforcement ribs 201 on the outer surface thereof.

Plate cutter 250 is further comprised of an apertured wall 254 with cutting ports 270 formed in cutter surface 260, and apertures or orifices extending from the openings of such ports 270 through wall 254 to inner discharge surface 256. In the operation of cutter assembly 190, liquid and ground up/shorn solids flow through cutting ports 270 into cavity 258 as indicated by arrow 199. In the preferred embodiment of cover 200 and plate cutter 250, annular cavity 258 is provided with an impeller eye 251 that is formed at the inner radial terminus of wall 252. Impeller eye 251, together with motor shaft bushing 176 and/or annular collar 145 of pump impeller 140 (see FIG. 4A), forms an annular passageway into the volute cavity 134 of pump 100. Liquid and homogenized solid material flows past impeller eye 251 as indicated by arrow 198 of FIG. 3. Impeller eye is dimensioned to throttle the amount of liquid allowed to be drawn by impeller 140 into volute cavity 134, thereby regulating the maximum load placed on pump motor 170. The optimum size of impeller eye 251 will vary with the properties of the liquid being pumped therethrough and the desired pump performance.

FIG. 8 is a magnified bottom or exterior view of the cutter assembly 190, which depicts in particular certain unique features of cutting ports 270 that provide superior cutting and grinding of solids. Referring to FIGS. 6A–6D and FIG. 8, a plurality of cutting ports 270 are formed in cutting surface 260 of plate cutter 250. Each of cutting ports 270 comprises a recessed entry opening 272 having a perimeter approximately the shape of a "FIG. 8," and a recessed bridge area 274 that connects adjacent wide openings 276 and 278 in recessed opening 272.

Without wishing to be bound to any particular theory, the applicant believes that in operation, when rotary cutter 300 is rotating and the cutting blades thereof are rotationally advancing as indicated by arrow 196 for cutting blade 320 and cutting edge 322, the pump impeller sucks material into recessed bridge area 274, enabling such material to at least partially "bridge" or fill the gap between wider openings 276 and 278. At the recessed bridge area 274 (i.e. the "neck" of the "FIG. 8" of the perimeter of recessed opening 270), on the side that is toward the direction of rotation of rotary cutter 300, there is provided a first V-slice cutting edge 282 and a second V-slice cutting edge 284 intersecting at an angle 280 directed opposite to said direction of rotation. When the cutting edge 322 of cutting blade 320 passes over these V-slice cutting edges 282 and 284, any solid material (not shown) that has dropped into recessed bridge area is cut and parted in two directions. A first portion of the solid material is directed to open area 276 and into orifice 286, and a second portion of the solid material is directed to open area 278 and orifice 288.

Subsequently, as cutting edge 322 of blade 320 advances further, and encroaches upon orifices 286 and 288, any solid material that is partially disposed in such orifices 286 and 288 is shorn off as cutting edge 322 passes the trailing edges 287 and 289 of such orifices. Shorn solid material and liquid that are disposed in orifices 286 and 288 are subsequently sucked into pump 100 by impeller 140 (see FIG. 3), and solid shorn material on the exterior of cutting edge 322 are swept from the cutting surface 260 of plate cutter 250 and back into the bulk liquid. This unique construction of cutting ports 270 results in "three cuts per slice" form each passage of a cutting blade 310–340 over a cutting port 270: a V-slice cut at V-slice cutting edges 282 and 284, a cut at trialing edge 287 of orifice 286, and a cut at trailing edge 289 at orifice 288. The angle 280 of first V-slice cutting edge 282 and a second V-slice cutting edge 284 is preferably between about 60 and about 120 degrees. In one preferred embodiment depicted in FIG. 8, V-slice cutting angle 280 is about 90 degrees.

In one preferred embodiment of grinder pump 100 and cutter assembly 190, rotary cutter 300 is provided with 4 blades, cutting surface 260 of plate cutter 250 is provided with 9 cutting ports, and pump 100 is provided with an AC motor that operates at 3540 revolutions per minute. Accordingly, in this embodiment of the applicant's cutter assembly 190, such cutter assembly provides about 372,600 cuts per minute of operation, and is thus highly effective at grinding the solid material in a liquid stream. It will be apparent that numerous other configurations of rotary cutters and plate cutters may be provided that will provide rapid and effective size reduction and pumping of entrained solids in a liquid stream.

The applicant's cutter assembly is 190 is further provided with additional features to provide more effective cutting of such solids. Referring again to FIG. 6B and FIG. 8, orifices 286 and 288 are preferably conical orifices. Such conical orifices provide a sharper angle for the cutting and shearing action with the blades of rotary cutter 300, with much the same effect as the rake angle 315 (see FIG. 5A) of the cutting edges of such blades. In addition, such conicity further serves to limit the amount of liquid inflow allowed to the pump impeller 140 in conjunction with impeller eye 251 of cover 200, thereby limiting the maximum hydraulic load on the pump motor 170. The angle of conicity of orifices 286 and 288 is preferably between about 10 degrees and about 20 degrees. In one preferred embodiment, the angle of conicity is about 15 degrees, and the entry diameter of conical orifices 286 and 288 is about 0.190 inch.

Referring again to FIG. 8, the cutting surface 260 of plate cutter 250 is preferably provided with a plurality of outer exclusion slots 292. Such outer exclusion slots are preferably slightly arcuate in shape and are disposed in a direction that forms an acute angle with the cutting edges 312–342 of the blades 310–340 of rotary cutter 300, as such cutting edges pass over exclusion slots 292. Referring also to FIG. 5B, these outer exclusion slots 292 work cooperatively with the outer recessed areas such as recessed area 318 of blade 310 to outwardly eject any cutting debris that has begun to accumulate under surface 316. The provision of such recessed area 318 in blade 310 (et seq.) and outer exclusion slots 292 prevents the accumulation and binding of any material between rotary cutter 300 and plate cutter 260. In the preferred embodiment, the number of outer exclusion slots 292 provided in cutting surface 260 is equal to the number of cutting ports 270 provided in cutting surface 260.

Referring now to FIG. 8, FIG. 6A and FIG. 6D, the cutting surface 260 of plate cutter 250 is preferably also provided with a plurality of inner exclusion slots 294. Such inner exclusion slots may also be slightly arcuate in shape and are disposed in a direction that forms an acute angle with the shaft bore 253 through wall 252 of cover 200. Inner exclusion slots 292 form channels from shaft bore 253 to at least several of openings 276 of cutting ports 270. Referring also to FIG. 5B, these inner exclusion slots 292 work cooperatively with the inner recessed areas such as recessed area 319 of blade 310 to inwardly direct any cutting debris that has begun to accumulate in recessed area 319 into orifice 288. The provision of such recessed area 319 in blade 310 (et seq.) and inner exclusion slots 294 also serves to prevent the accumulation and binding of any material between rotary cutter 300 and plate cutter 260, making the assembly self cleaning. In one preferred embodiment depicted in FIG. 6A, three exclusion slots 294 are provided in cutting surface 260.

Inner exclusion slots 294 and outer exclusion slots 292 may be provided with a relatively small cross-section. In one preferred embodiment in which plate cutter 250 is 3.4 inches in diameter, such slots are provided with a width of 0.05 inch and a depth of 0.09 inch.

Grinder pump 100 is further provided with additional beneficial features to more effectively pump liquid containing homogenized solids produced by cutter assembly 190. Referring now to FIG. 3, and FIGS. 4A and 4B, inner surface of wall 202 of cover 200 is provided with a plurality of spiral grooves 259 formed therein. These spiral grooves 259 spiral in an outward direction with respect to the direction of rotation of pump impeller 140, and thus these spiral grooves 259 work cooperatively with the vanes 142 of impeller 140 to outwardly eject any solid debris that begins to accumulate between impeller vanes 142 and wall 202.

In like manner, the inner surface of wall 152 of cover motor plate 150 is provided with a spiral groove 159 formed therein. This spiral groove 159 also spirals in an outward direction with respect to the direction of rotation of pump impeller 140, and thus the spiral groove 159 works cooperatively with ribs 144 (see FIG. 4A and FIG. 9) formed on the upper surface of impeller 140 to outwardly eject any solid debris that begins to accumulate between such upper surface of impeller 140 and wall 152.

Figure 9:
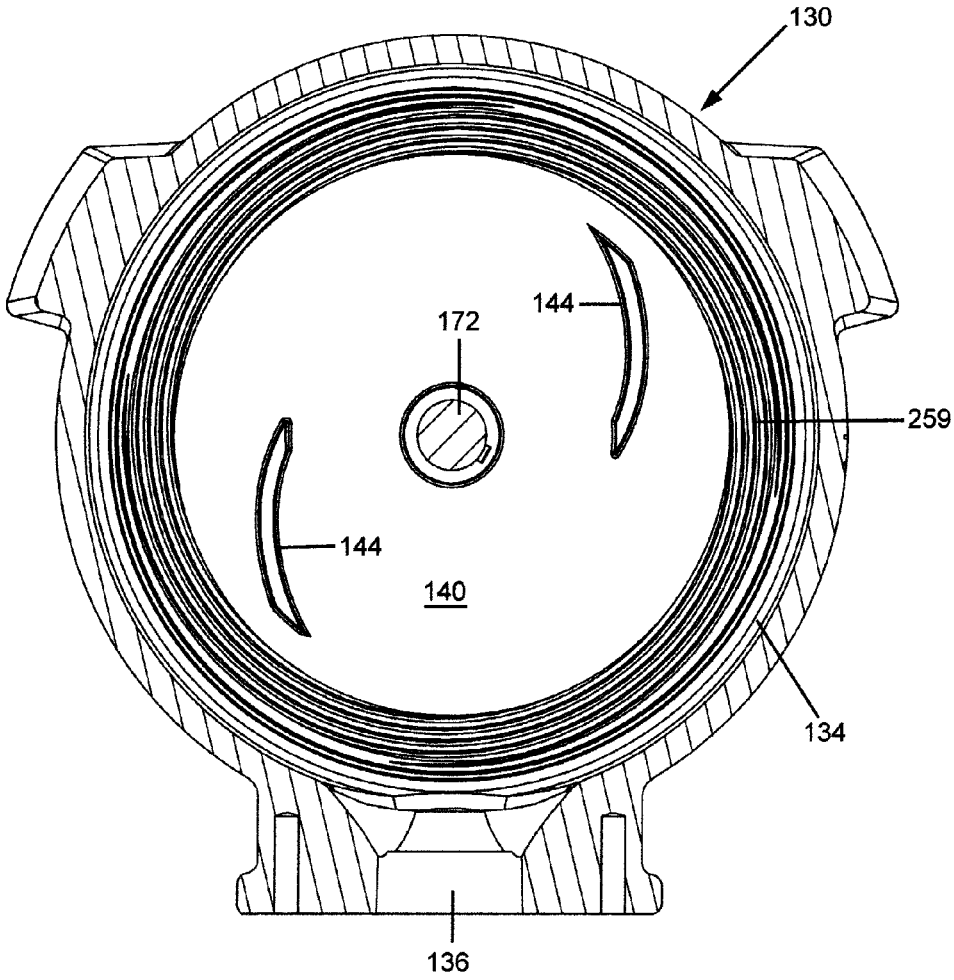
FIG. 9 is a vertical downward cross-sectional view of a preferred volute of the applicant's grinder pump, taken along line 9—9 of FIG. 1.

FIG. 9 is a vertical downward cross-sectional view of a preferred volute of the applicant's grinder pump, taken along line 9—9 of FIG. 1. Referring to FIG. 3 and FIG. 9, the applicant's grinder pump 100 is comprised of a volute 134 that has a simple annular shape, without complex pockets or barriers, or volute shape known as a "cutwater" where solid debris may accumulate. Liquid and homogenized solids are swept around the outer circumferential wall 138 of volute 134, and are subsequently discharged out through outlet 136.

It is, therefore, apparent that there has been provided, in accordance with the present invention, a cutting assembly for size reduction of solids in a liquid to be pumped, and a grinder pump comprising such a cutter assembly. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A cutting assembly for size reduction of solids in a liquid to be pumped, said cutting assembly comprising:

a. a drive shaft rotatable in a first direction of rotation;

b. a rotary cutter rotatably engaged with said drive shaft and comprised of at least a first cutting blade and a second cutting blade, each of said first and said second cutting blades including a leading cutting edge advanceable in said direction of rotation, said leading cutting edge formed at a junction of a leading side wall of said blade and a flat base of said blade;

c. a plate cutter comprised of an apertured wall including an inner discharge surface, and an outer cutter surface, said outer cutter surface including a plurality of cutting ports, each of said cutting ports comprising an entry opening, a first orifice passing through said apertured wall to said inner discharge surface, and a second orifice passing though said apertured wall to said inner discharge surface, said entry opening further comprising:

i) a first V-slice cutting edge and a second V-slice cutting edge intersecting at an angle directed opposite to said direction of rotation;

ii) a first cutting edge of said first orifice connected to said first V-slice cutting edge; and iii) a second cutting edge of said second orifice connected to said second V-slice cutting edge;

wherein when said rotary cutter is rotated in said first direction of rotation, said cutting blades are rotationally advanced along said outer cutter surface of said plate cutter in a shearing action against said first V-slice cutting edge, said second V-slice cutting edge, said first cutting edge of said first orifice, and said second cutting edge of said second orifice of said cutting ports of said outer cutter surface of said plate cutter.

2. The cutting assembly as recited in claim 1, wherein said entry openings of said cutting ports of said outer cutter surface further comprise a perimeter forming a first wide opening adjacent to said first orifice, a second wide opening adjacent to said second orifice, and a recessed bridge area between said first wide opening and said second wide opening.

3. The cutting assembly as recited in claim 2, wherein said first orifice and said second orifice of said cutting ports are conical orifices.

4. The cutting assembly as recited in claim 1, wherein said outer cutter surface of said plate cutter further comprises a plurality of outer exclusion slots, each of said outer exclusion slots forming an acute angle with a first one of said leading cutting edges of said cutting blades of said cutter when said first one of said leading cutting edges of said cutting blades is rotationally advanced past said each of said outer exclusion slots.

5. The cutting assembly as recited in claim 4, wherein said outer cutter surface of said plate cutter further comprises a plurality of inner exclusion slots, each of said inner exclusion slots forming a channel from a shaft bore through said apertured wall of said plate cutter to one of said cutting ports.

6. The cutting assembly as recited in claim 1, wherein said leading cutting edge of each of said first cutting blade and said second cutting blade has an arcuate shape sweeping radially outward and back in a direction opposite to said first direction of rotation.

7. The cutting assembly as recited in claim 6, wherein in each of said first cutting blade and said second cutting blade, said leading cutting edge formed at said junction of said leading side wall of said blade and said flat base of said blade is formed at an rake angle of between about 60 degrees and about 120 degrees.

8. The cutting assembly as recited in claim 7, wherein said rake angle is an acute rake angle of between about 60 degrees and about 90 degrees.

9. The cutting assembly as recited in claim 7, wherein said rake angle is an obtuse rake angle of between about 90 degrees and about 120 degrees.

10. The cutting assembly as recited in claim 7, wherein each of said first cutting blade and said second cutting blade are provided with at least a first recessed area adjacent to said flat base of each of said first cutting blade and said second cutting blade.

11. The cutting assembly as recited in claim 10, wherein said rotary cutter further comprises a third cutting blade and a fourth cutting blade, each of said third and said fourth cutting blades including a leading cutting edge advanceable in said direction of rotation, said leading cutting edge formed at a junction of a leading side wall of said blade and a flat base of said blade.

12. The cutting assembly as recited in claim 11, wherein said plate cutter is comprised of at least four of said cutting ports in said outer cutting surface.

13. The cutting assembly as recited in claim 11, wherein said plate cutter is comprised of at least six of said cutting ports in said outer cutting surface.

14. The cutting assembly as recited in claim 11, wherein said plate cutter is comprised of nine of said cutting ports in said outer cutting surface.

15. The cutting assembly as recited in claim 1, wherein said rotary cutter is comprised of a shaft bore and a counterbore for receiving a head of a fastener.

16. The cutting assembly as recited in claim 1, wherein said flat base of said first cutting blade and said flat base of said second cutting blade are coplanar, and wherein said flat bases of said first cutting blade and said second cutting blade have a running clearance with said outer cutter surface of said plate cutter of between zero inches and about 0.01 inches.

17. The cutting assembly as recited in claim 1, wherein said plate cutter is integrally formed into a volute cover of a grinder pump.

18. The cutting assembly as recited in claim 17, wherein said volute cover comprises a volute wall including an impeller eye, and wherein an annular cavity is formed between said apertured wall of said plate cutter and said volute wall of said volute cover.

19. A grinder pump comprising a housing including a motor housing portion enclosing a pump motor, and a volute portion forming a pump volute, said pump volute enclosing a pump impeller; a volute cover; and a cutting assembly for size reduction of solids in a liquid to be pumped, said cutting assembly comprising:

a. a drive shaft rotatable in a first direction of rotation and driven by said pump motor;

b. a rotary cutter rotatably engaged with said drive shaft and comprised of at least a first cutting blade and a second cutting blade, each of said first and said second cutting blades including a leading cutting edge advanceable in said direction of rotation, said leading cutting edge formed at a junction of a leading side wall of said blade and a flat base of said blade;

c. a plate cutter comprised of an apertured wall including an inner discharge surface, and an outer cutter surface, said outer cutter surface including a plurality of cutting ports, each of said cutting ports comprising an entry opening, a first orifice passing through said apertured wall to said inner discharge surface, and a second orifice passing though said apertured wall to said inner discharge surface, said entry opening further comprising:

i) a first V-slice cutting edge and a second V-slice cutting edge intersecting at an angle directed opposite to said direction of rotation;

ii) a first cutting edge of said first orifice connected to said first V-slice cutting edge; and iii) a second cutting edge of said second orifice connected to said second V-slice cutting edge;

wherein when said rotary cutter is rotated in said first direction of rotation, said cutting blades are rotationally advanced along said outer cutter surface of said plate cutter in a shearing action against said first V-slice cutting edge, said second V-slice cutting edge, said first cutting edge of said first orifice, and said second cutting edge of said second orifice of said cutting ports of said outer cutter surface of said plate cutter.

20. The grinder pump as recited in claim 19, wherein said plate cutter is integrally formed into said volute cover of said grinder pump.

* * * * *